US007446786B2

(12) United States Patent
Mikami et al.

(10) Patent No.: US 7,446,786 B2
(45) Date of Patent: Nov. 4, 2008

(54) IMAGE FORMING DEVICE

(75) Inventors: Masato Mikami, Saitama (JP); Kunihiro Maie, Saitama (JP); Kouji Tsutsumi, Saitama (JP); Shingo Yano, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 245 days.

(21) Appl. No.: 11/115,207

(22) Filed: Apr. 27, 2005

(65) Prior Publication Data

US 2006/0098075 A1 May 11, 2006

(30) Foreign Application Priority Data

Nov. 10, 2004 (JP) ..... 2004-326502

(51) Int. Cl.
*G03G 15/00* (2006.01)
*B41J 2/447* (2006.01)
*B41J 2/45* (2006.01)

(52) U.S. Cl. ..... 347/138; 347/263

(58) Field of Classification Search ..... 347/241–242, 347/263, 233, 238, 138
See application file for complete search history.

(56) References Cited

U.S. PATENT DOCUMENTS

| | | | | |
|---|---|---|---|---|
| 5,872,367 | A * | 2/1999 | Wolber et al. | 250/522.1 |
| 6,545,693 | B2 * | 4/2003 | Kitayama et al. | 347/138 |
| 7,038,706 | B1 * | 5/2006 | Hiyoshi | 347/238 |
| 2002/0051049 | A1 * | 5/2002 | Hiyoshi | 347/130 |
| 2004/0130613 | A1 * | 7/2004 | To et al. | 347/245 |

FOREIGN PATENT DOCUMENTS

| | | | |
|---|---|---|---|
| JP | 62-175782 | A | 8/1987 |
| JP | 5-127465 | A | 5/1993 |
| JP | 6-255175 | A | 9/1994 |
| JP | 2002-14524 | A | 1/2002 |
| JP | 2002-52727 | A | 2/2002 |

* cited by examiner

*Primary Examiner*—Huan H Tran
(74) *Attorney, Agent, or Firm*—Sughrue Mion, PLLC

(57) ABSTRACT

An image forming device, comprising: a cylindrical rotatable photoreceptor rotatably supported by an apparatus body; an exposure device in which plural exposure heads which expose an outer circumferential surface of the rotatable photoreceptor are disposed in a common housing in such a manner that exposure sections thereof are consecutively positioned; and a supporting unit having a position adjusting mechanism for adjusting a posture of the exposure device in at least two locations, which supports the exposure device and which is fixed on the apparatus body.

10 Claims, 9 Drawing Sheets

IMAGE FORMING DEVICE

BACKGROUND OF THE INVENTION

1. Field of the invention

The present invention relates to a mechanism for adjusting the focal position error of exposure heads in an image forming device with a wide exposure width by disposing plural exposure heads.

2. Description of the Related Art

Image forming devices which handle wide paper sizes such as A0 sized paper conventionally use a single A0 size LED head, but these LED heads have poor production yields and low demand quantities, so the cost is high and the LED head will be high priced.

Therefore, in recent years, technology to expose a wide region using multiple heads of a small common size has been used in order to reduce costs.

For instance, as shown in FIG. 9A, exposure device R100 is made with heads h101, h102, h103 fixed in a housing k100. As shown in FIG. 9B which is a view in the direction of arrow A in FIG. 9A, the light emitted from the LED contained in each of the heads h101, h102, h103 passes through lenses r101, r102, r103 respectively which are located at the external boundary regions, and the light is collected and exposed with connecting focal points on the outer circumferential surface of a cylindrical photosensitive drum kd.

In order to obtain an A0 size exposure width, the exposure device R100 aligns three A3 size heads h101, h102, h103 and longitudinally connects the exposure regions of the lenses r101, r102, r103 of each head to ensure the desired exposure width.

At this time, image shift occurring at the seams of the exposure regions for each head h101, h102, h103 will be a problem, and technology to reduce this effect, such as to randomly switch the image information from one head to another head for each scan line in order to make the image shift less noticeable, has been introduced in Japanese Patent Application Laid-open No. 6-255175.

Furthermore, the Japanese Patent Application Laid-open No. 2002-52727 shows a method for detecting and correcting image shift, as well as a method for correcting intensity variation at the head exposure region seams.

Incidentally, the method for determining the focal position of the LED head for focal position adjusting of an exposure device generally uses a method of establishing a focal direction striking member on both sides of the head and adjusting the position using this member. Technology where the striking member which contacts and rotates the photosensitive drum is a space roller is shown in Japanese Patent Application Laid-open No. 62-175782.

Furthermore, as a means for space roller application, Japanese Patent Application Laid-open No. 5-127465 introduces a technology where plural heads are connected and arranged on the inside of a transparent photosensitive drum, and each head is positioned on the drum inner circumferential surface by space rollers. This technology has an advantage in that wearing of the outer circumferential surface of the photoreceptor does not occur, but currently transparent photosensitive bodies are not common.

Therefore, as shown in FIG. 9A, when space rollers are used for a exposure device R100 which has a housing with plural heads mounted in a staggered pattern, a method is conceivable wherein image formation dot lines kl1, kl2 are divided into two columns, so rollers c are established in 4 locations as shown in FIG. 9A, and striking is performed on four points on the outer circumferential surface of the photosensitive drum kd.

On the other hand, when space rollers are not used for mounting of the exposure devices R100, a three-point support system which is the basis for component positioning is generally used for mounting of the exposure devices R100 to the image forming device. Of these three points, two points are for focal positioning and receive the focal direction striking member of both sides of the LED head, and the third point is for controlling the angle of the head to point the exposure direction toward the center of the drum. This technology is shown in Japanese Patent Application Laid-open No. 2002-14524, and this technology has been commonly used in the past.

Note, there are also cases where one of the three-points is able to be adjusted in order to perform fine adjustments to the parallelism of the exposure line with regards to the rotational axis of the exposure drum in order to prevent color shifting of the heads in a color printer which uses plural heads.

Incidentally, when adjusting the focal position of the exposure device, as shown in Japanese Patent Application Laid-open No. 62-175782, when plural heads are joined together and used, the position on both sides of each of the heads will not necessarily be outside of the image area, and if the space roller is made to roll and contact inside the image area of the photosensitive drum, wearing of the photosensitive drum will be promoted, and image lines will occur.

On the other hand, if rollers c are established in four locations as shown in FIG. 9A, the method for striking the four points on the outer surface of the photosensitive drum kd is to simultaneously contact all for points on the drum, so either the orientation of the exposure device R100 with regard to the axis of the drum will be made to vary, or the exposure devices R100 must be forcefully pressed onto the drum and the housing k100 must be deformed.

However, in this case, structural instability is possible for positioning with regards to the drum kd because the drum kd itself is the basis and is rotationally driven.

Furthermore, if plural LED heads are mounted on a common housing to make a wide exposure device, an exposure device R100, which for instance has three LED heads h101, h102, h103 in a staggered arrangement on a housing k100 as shown in FIG. 9A, has focal positions 101*a*, 101*b*, 102*a*, 102*b*, 103*a*, 103*b* to be optimized on both sides of each of the heads h101, h102, h103, or in other words at six locations.

With this structure, if there is error in the position of these six locations during the assembly of the exposure device R100, optimizing all of the focal positions for the LED heads h101, h102, h103 by adjusting the mounting of the exposure device R100 will not be possible. Furthermore, there is an individual difference in the position error on the photosensitive drum kd side for each device.

Therefore, in order to completely eliminate differences in intensity which occurs at the seam lines for the heads, or in other words at the edge region 101*b* for head h101, edge region 102*b* for head h102, and edge region 103*b* for head h103, the focal point of each head must be readjusted while matching the individual differences of the devices.

However, the focal depth of the LED heads is only several tens of micrometers and great skill is required for such minute adjustments, and therefore there is a problem with long adjustment times.

SUMMARY OF THE INVENTION

The present invention has been made in view of the above circumstances and provides an image forming device with a simple structure which can prevent image intensity variation which occurs at the seam lines between heads and can eliminate focus relative error in plural LED heads.

An aspect of the present invention provides an image forming device, comprising: a cylindrical rotatable photoreceptor rotatably supported by an apparatus body; an exposure device in which plural exposure heads which expose an outer circumferential surface of the rotatable photoreceptor are disposed in a common housing in such a manner that exposure sections thereof are consecutively positioned; and a supporting unit having a position adjusting mechanism for adjusting a posture of the exposure device in at least two locations, which supports the exposure device and which is fixed on the apparatus body.

According to the image forming device of the above-mentioned aspect of the present invention, intensity variation at the seam lines between exposure heads can be eliminated by simply adjusting the orientation of the exposure devices using a position adjusting mechanism without performing detailed adjustments on each exposure head.

Furthermore, a position adjusting mechanism is provided on the side of the supporting unit which is secured to the apparatus body, so compatibility of the exposure device mounting is supported, and there is an advantage that re-adjusting the exposure devices will not be necessary when exchanging or recycling components.

Furthermore, the seam lines between exposure heads are not directly affected, so even if image shift adjustments have already been made for the seam line regions, adjustments can be made without affecting the positional relationship between seam regions.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be described in detail while referring to the attached drawings.

Embodiment 1

Figure 1:
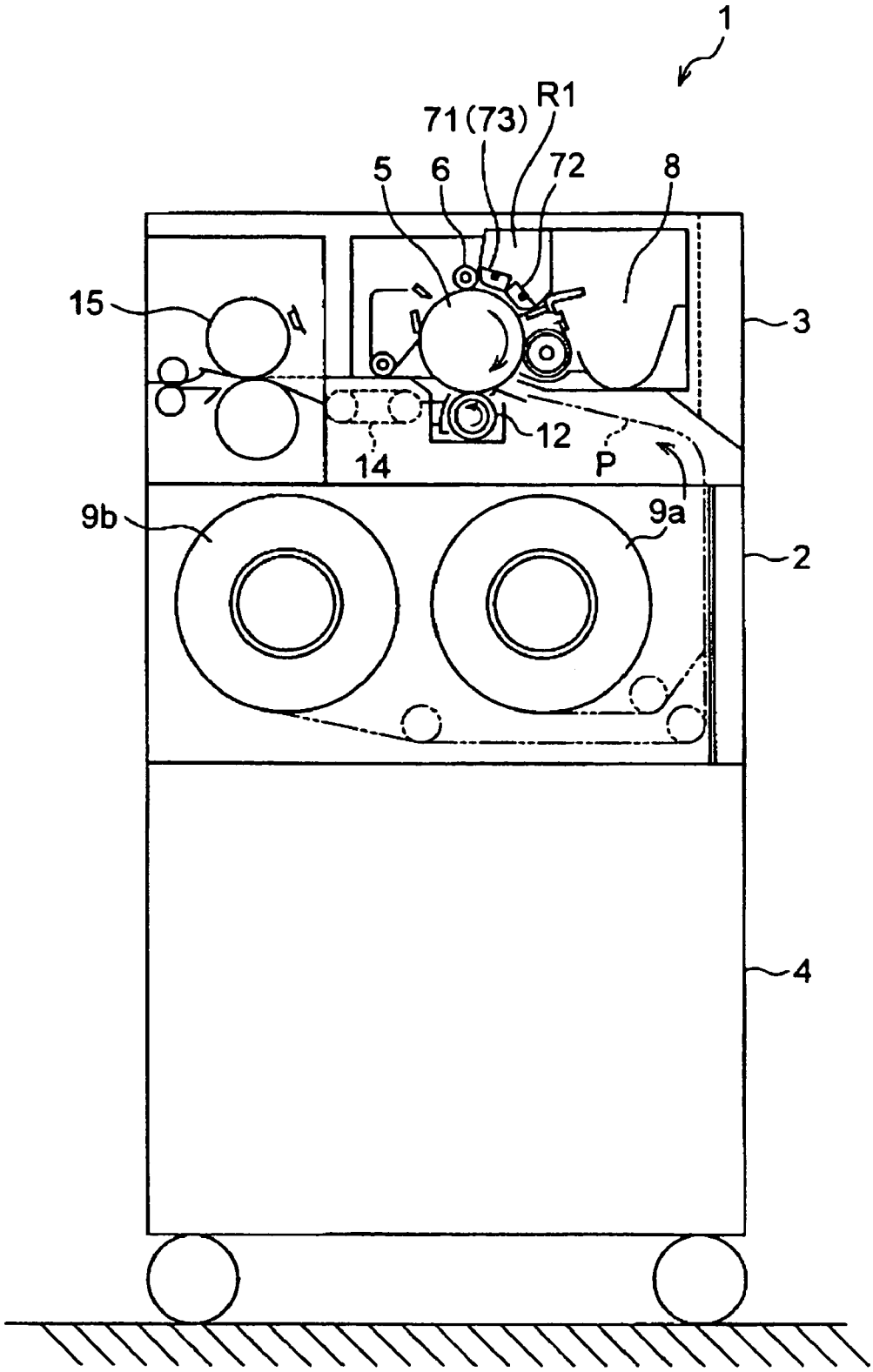
FIG. 1 is a conceptual major component side cross section view showing the image forming device of an embodiment 1 of the present invention.

As shown in FIG. 1, a conceptual critical unit side cross section view, the image forming device 1 of embodiment 1 which uses the present invention is roughly comprised of a paper feeder 2 which feeds paper for forming an image, and image forming unit 3 which forms an image on the paper sent from the paper feeder 2, a control circuit for controlling the paper feeder 2 and the image forming unit 3, and a storage units 4 for storing extra paper feeder rolls or the like.

Inside the image forming unit 3, a photosensitive drum (rotating type photoreceptor) 5 which acts as an image information image support member for forming an image is rotatably supported by the apparatus body.

The photosensitive drum 5 has a cylindrical form approximately 100 mm in diameter with a center axis which is perpendicular to the surface of the paper in FIG. 1, is coated with a photoreceptor made from an organic photosensitive agent such as OPC on the outer circumferential surface of the drum which is made from aluminum, and is rotationally driven at a prescribed rotational speed in the direction of the arrow shown in FIG. 1.

Opposite the outer circumferential surface of the photosensitive drum 5, a first LED print head (Hereinafter abbreviated as first LPH) (exposure head) 71, a second LED print head (Hereinafter abbreviated as second LPH) (exposure head) 72, and a third LED print head (Hereinafter abbreviated as third LPH) (exposure head) 73 are arranged in the exposure device R1 in a form extending parallel to the width direction of the outer circumferential surface of the photosensitive drum 5, in order to form an electrostatic latent image corresponding to the image information on the outer circumferential surface of the photosensitive drum 5.

Figure 2B:
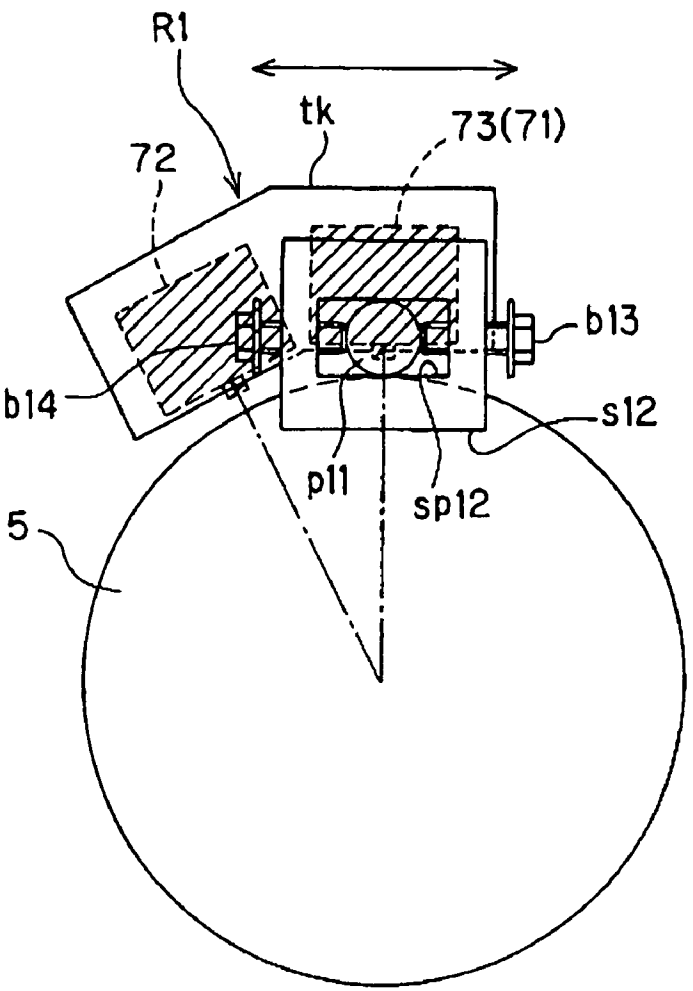
FIG. 2A and FIG. 2B are a conceptual side view showing an enlarged view of the area around the exposure devices and photosensitive drum of the image forming device shown in FIG. 1, and a conceptual side view of the area around the exposure devices and photosensitive drum shown in FIG. 2A, as seen from the back side.
Figure 2A:
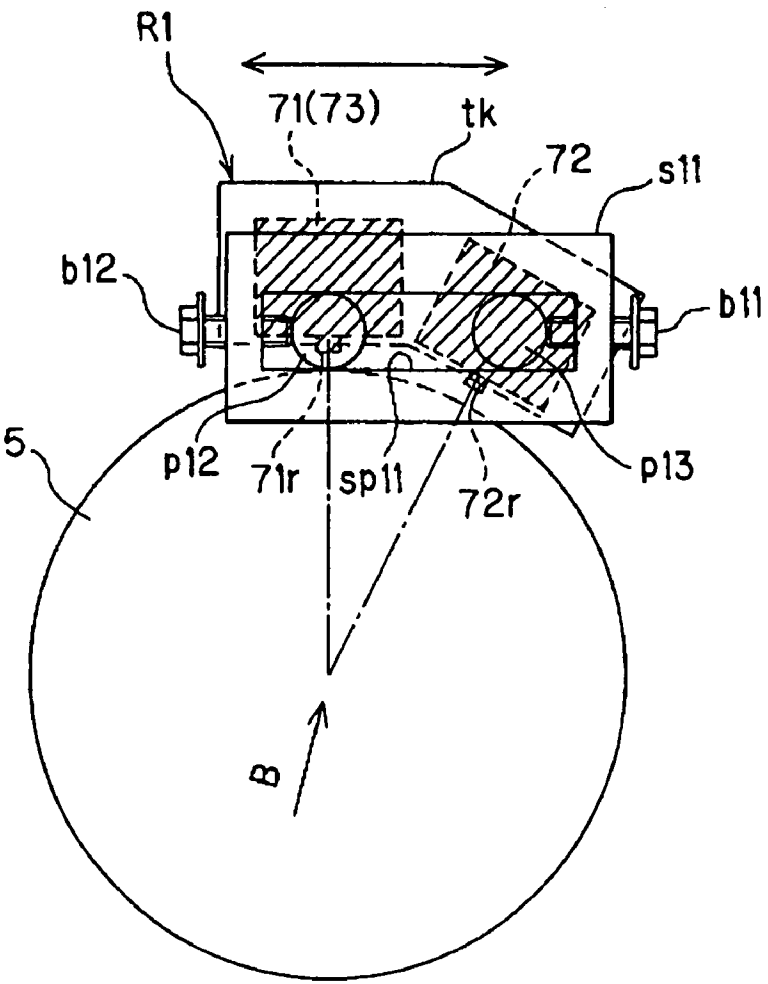
Figure 3:
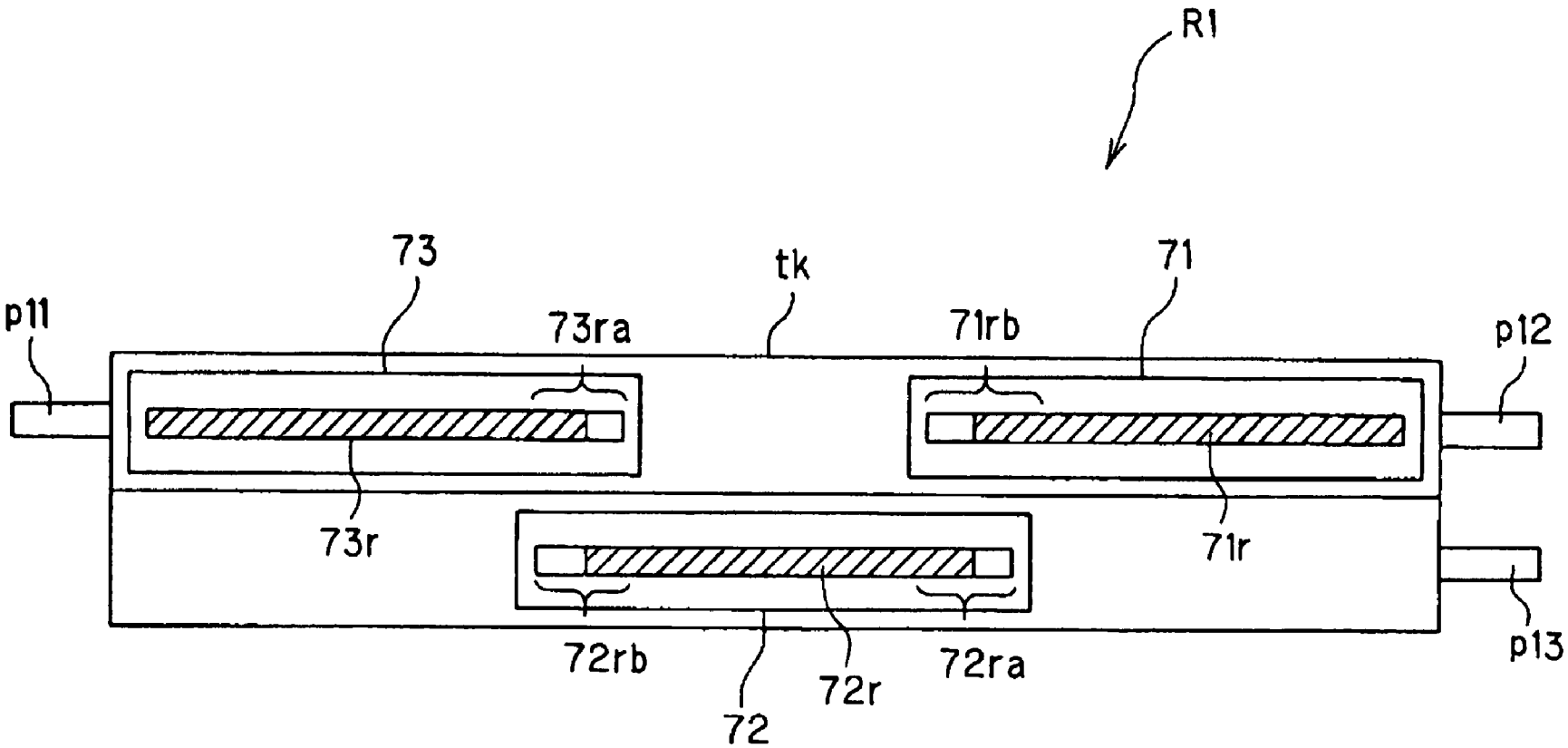
FIG. 3 is a view of the exposure device shown in FIG. 2A in the B direction.

FIG. 2A is a conceptual side view showing an enlarged view of the area around the exposure device R1 and the photosensitive drum 5 shown in FIG. 1, and FIG. 3 is a view of the exposure device R1 shown in FIG. 2A in the direction of arrow B.

LPH 71, 72, 73 are arranged in a row on a substrate, and house a mounted LED (not shown in the drawings), SELFOC® lenses 71*r*, 72*r*, 73*r* are arranged at the boundary region to the outside opposite the LED series which are arranged in a row, and the light from each of the LED pass through and is collected by the SELFOC® lenses 71*r*, 72*r*, 73*r*, and exposed onto the outer circumferential surface of the photosensitive drum 5.

The photosensitive drum 5 is rotationally driven while images are successively formed on the region along the width direction of the outer circumferential surface to form the desired image on the circumferential surface, but because the dimensions of the outer circumferential surface of the photosensitive drum 5 are large in the width direction, the exposure regions of LPH 71, 72, 73 are joined together to form an image.

In other words, as shown in FIG. 3, the SELFOC® lenses 71*r*, 72*r*, 73*r* which are the exposure regions of each of the LPH 71, 72, 73 are provided in order to provide the prescribed wide exposure width, and opposite the photosensitive drum 5 outer circumferential surface, LPH 71, 72, 73 are arranged in a staggered position on exposure device housing tk such that the exposure regions are connected along the width direction of the outer circumferential surface.

Furthermore, the exposure edge 71*rb* of the first LPH 71 and the exposure edge 72*ra* of the second LPH 72 are arranged to overlap in the width direction of the outer circumferential surface of the photosensitive drum 5 such that the image between LPH 71, 72 in the width direction of the outer circumferential surface of the photosensitive drum 5 is continuous without breaks.

Simultaneously, the exposure edge 72*rb* of the second LPH 72 and the exposure edge 73*ra* of the third LPH 73 are arranged to overlap in the width direction of the outer circumferential surface of the photosensitive drum 5 such that the image between LPH 72, 73 in the width direction of the outer circumferential surface of the photosensitive drum 5 is continuous without breaks.

In this case, if the exposure regions of LPH 71, 72, 73 are used for forming the image, in the region where the exposure edge 71*rb* of the first LPH 71 and the exposure edge 72*ra* of the second LPH overlap, and in the region where the exposure edge 72*rb* of the second LPH 72 and the exposure edge 73*ra* of the third LPH overlap in the widthwise direction of the outer circumferential surface of the photosensitive drum 5, the image will be doubled and proper image forming cannot be accomplished. Therefore, the image signal is controlled by a control unit so that an exposure region (shaded region in FIG. 3) is formed which connects without overlapping the exposure regions of LPH 71, 72, 73.

Next, an outline of the process of forming an image using an image forming device 1 with the aforementioned structure will be described.

As shown in FIG. 1, rolled paper p with an A0 or A1 size or the like which is stored in the paper feeder 2 is supplied from paper rolls 9*a*, 9*b* to the transfer roller 12 and the outer circumferential surface of the photosensitive drum 5 which rotates in the direction of the arrow.

The photosensitive drum 5 rotates in the direction of the arrow, and after the outer circumferential surface is temporarily charged to a prescribed potential by a charged roller 6 which is a primary charging unit, and image is exposed on the outer circumferential surface by plural image exposing units, namely first LPH 71, second LPH 72, and third LPH 73, and an electrostatic latent image is formed with an electric potential difference corresponding to the image information. In this manner, an electrostatic latent image formed on the outer circumferential surface of the photosensitive drum 5 is developed and attached by a development device 8 to form a toner image.

The toner image formed on the outer circumferential surface of the photosensitive drum 5 is transferred to the roll paper p provided as described above by the transfer roller 12, the roll paper p to which the toner image is transferred is transported to a fusing unit 15 by a transport belt 14, and the toner image is then fixed using heat and pressure by the fusing unit 15. If necessary, the roll paper is cut to a desired size such as size A0, and then discharged onto a paper discharged tray (not shown in the drawings) located on the outside of the image forming device body 1.

Incidentally, LPH 71, 72, 73 are mounted on the metal exposure device housing tk as shown in FIG. 3, and one end of the exposure device housing tk has a cylindrical pin p11 which is crimped in place to form a single stud, while the other end of the exposure device housing tk has two studs formed by crimping cylindrical pins p12, p13 in place, to form the exposure unit R1.

The exposure unit R1 is manufactured as a single piece with a prescribed level of precision as a component part of the image forming device 1, and is mounted and secured to the device body.

As shown in FIG. 2A, when mounted, LPH 71, 73 are positioned parallel to the tangent line opposite the outer circumferential surface of the photosensitive drum 5. Similarly, when LPH 72 is mounted, it is positioned parallel to the tangent line opposite the outer circumferential surface of the photosensitive drum 5, and the design is such that the distance from the outer surface of the SELFOC® lenses 71*r*, 72*r*, 73*r* of the LPH 71, 72, 73 to the outer circumferential surface of the photosensitive drum 5 is equal to the focal distance. The focal distance is between 2 and 3 mm, a variation level of ±50 μm is permissible, and the desired image is exposed on the outer circumferential surface in order to ensure the precision of the focal distance.

If the seam region of LPH 71 and LPH 72 cannot have the respective desired focal distances, intensity variation observed as tint intensity will occur, and similarly, if the seam region of LPH 72 and LPH 73 cannot have the respective desired focal distances, intensity variation will occur.

In order to mount the exposure unit R1 in the prescribed location, one end of the exposure unit R1 has a supporting member (supporting unit) s11 which is the focus standard and has an adjusting hole (position adjusting mechanism) sp11 into which pins p12, p13 are fit and can slide to adjust as shown in FIG. 2A. Adjustment screws (position adjusting mechanism) b11, b12 are screwed into both sides of the support member s11.

On the other hand, at the other end of the exposure unit R1, a support member (supporting unit) s12, which is the focus standard, is secured to the apparatus body and has an adjusting hole (position adjusting mechanism) sp12 into which pin p11 is fit and can slide to adjust as shown in FIG. 2B which is a view seen from the back side of FIG. 2A. Adjustment screws (position adjusting mechanism) b13, b14 are screwed into both sides of the support member s12.

With this construction, as shown in FIG. 2A, the pins p11, p13 of the exposure unit R1 are fit into the adjustment hole sp11 of the support member s11 and pressed by adjustment screws b11, b12 to adjust and set the position of one end of the exposure unit R1 in the direction of the arrow, and as shown in FIG. 2B, the pin p11 of the exposure unit R1 is fit into the adjustment hole sp 12 of the support member s12 and pressed by adjustment screws b13, b14 to adjust and set the position of one end of the exposure unit R1 in the direction of the arrow.

In other words, the pins p12, p13 at one end of the exposure unit R are supported by support member s11, and one end of the exposure unit R can be moved and adjusted in the direction of the arrow by rotating the adjust screws b11, b12. Furthermore, the pin p11 at the other end of the exposure unit R is supported by support member s12, and the other end of the exposure unit R can be moved and adjusted in the direction of the arrow by rotating the adjust screws b13, b14.

With the above structure, if the direction of movement of the exposure unit R is in the direction perpendicular to the exposure direction of LPH 71, 73, or in other words the direction tangential to the outer circumference surface of the photosensitive drum 5, the image forming distance of LPH 71, 73 will hardly change even though the exposure unit R is moved, so at this time, of the three LPH, the focus of LPH 71 and LPH 73 are almost optimized. On the other hand, the movement in the exposure direction which changes the image forming distance of LPH 72 will be large, so the image forming distance of LPH 72 can be significantly changed and adjusted.

Therefore, the relative error of the image forming distance of LPH 72 can be eliminated with LPH 71, 73 as a standard. Note, the adjustment target is easily achieved because the LPH 71, 73 standard is clearly seen.

However, the direction of adjustment of the exposure unit R1 does not necessarily have to be in the same direction as the arrow shown in FIG. 2. For instance, the direction may be perpendicular to the exposure direction of LPH 72 (tangential to the outer circumferential surface of the photosensitive drum 5), or in a direction between these two examples, and can be arbitrarily selected depending on the position and direction of the pins p11, p12, p13 and the support members s11, s12 of the exposure unit R1.

In this manner, regardless of the adjustment direction of the exposure unit R1, intensity variation at the seam between LPH 71, 72 and the intensity variation at the seam between LPH 72, 73 can be eliminated by eliminating the relative image forming distance error between LPH 71, 72, 73.

Furthermore, FIG. 2 shows the method of striking adjust screws b11, b12, b13, b14 in order to briefly describe the structure, but the adjustment mechanism is not restricted to this example and various other applications are possible, such as a method to strike and adjust the support part of the exposure unit R1 using eccentric pins where the dimension from the center to the outer edge is eccentric, or a method to reduce the spacer thickness between the support members which hold the supports and the device body of the exposure unit R1 in place.

Furthermore, with the conventional technology, the screw adjustment of the exposure unit is in only one location, so adjusting the image forming distance difference of the head seam region in two locations is not possible, but with the present invention, the adjustment is performed in two locations, namely both end supports of the exposure unit R1, so the image forming distance difference in two locations, namely the seam region of LPH 71, 72 and the seam region LPH 72, 73, can be adjusted together.

Next, a method of adjusting the position of the exposure unit using eccentric pins which is an alternate of embodiment 1 will be described.

Figure 4:
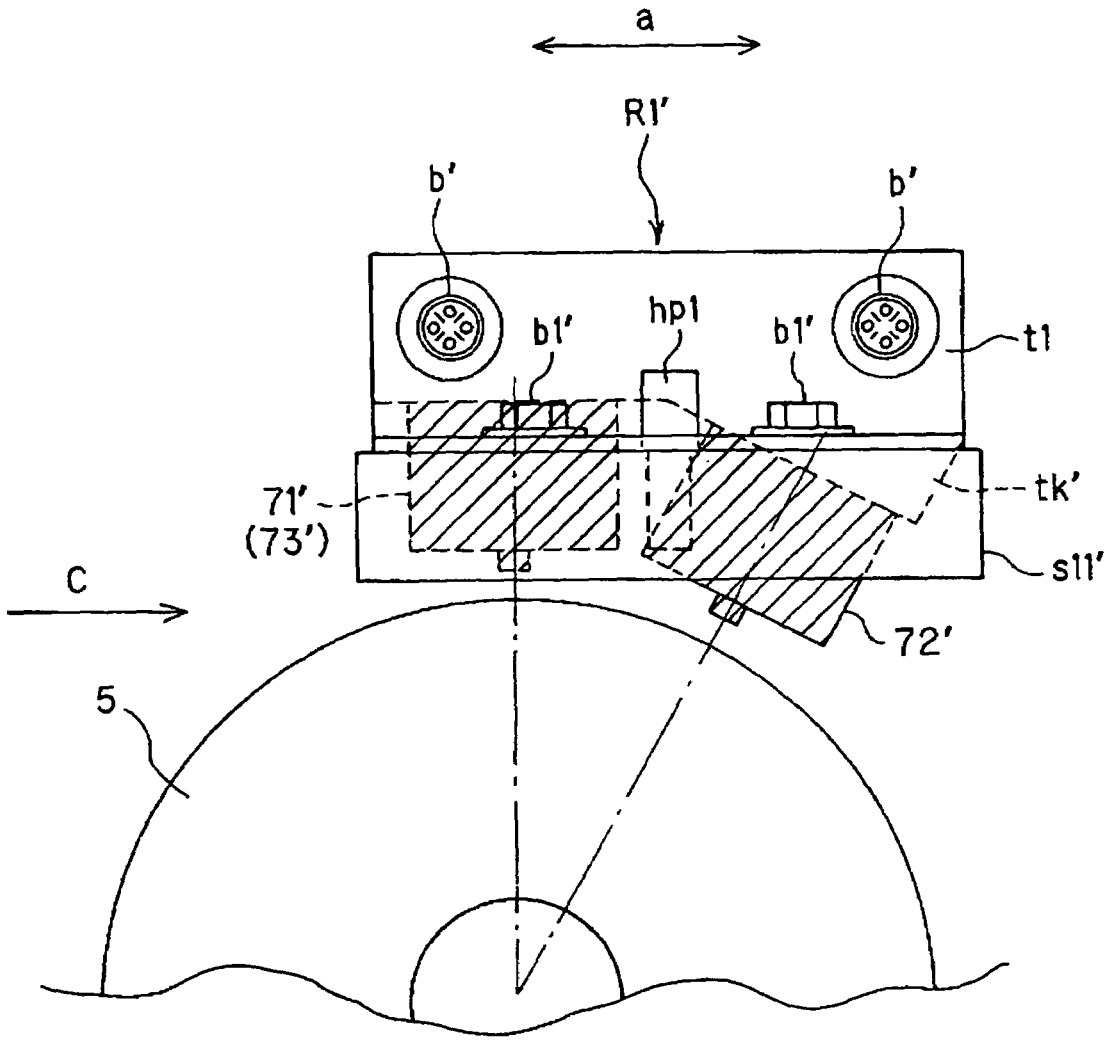
FIG. 4 is a conceptual expanded side view showing a close-up of the region around the exposure device and photosensitive drum which are alternates of embodiment 1.
Figure 5A:
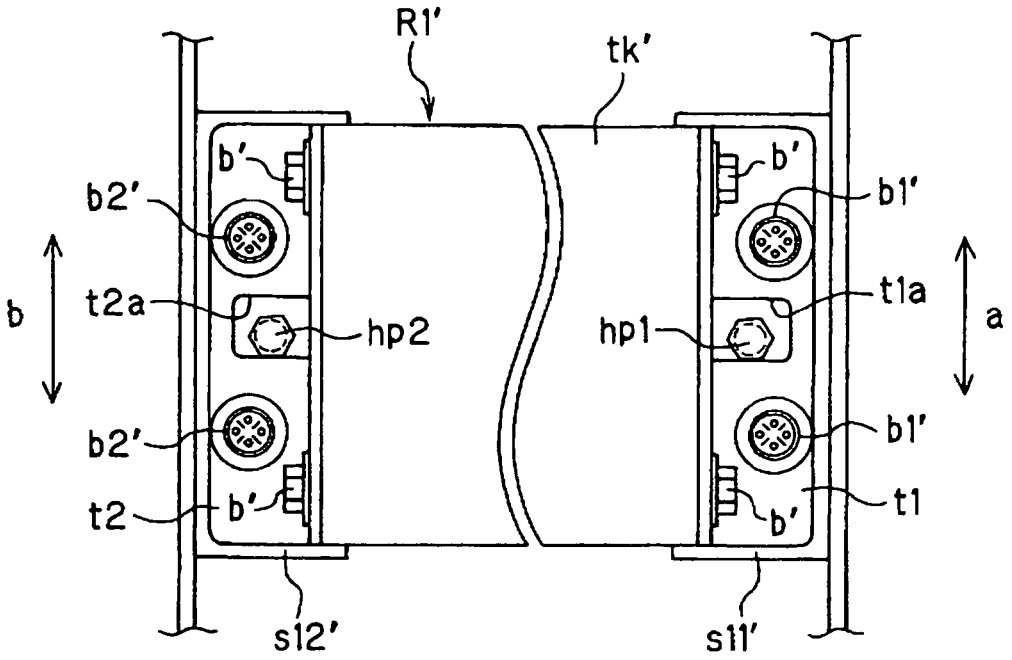
FIG. 5A and FIG. 5B are a top view showing the area around the exposure device and photosensitive drum shown in FIG. 4, and a view in the direction of arrow C of the exposure device and photosensitive drum shown in FIG. 4.
Figure 5B:
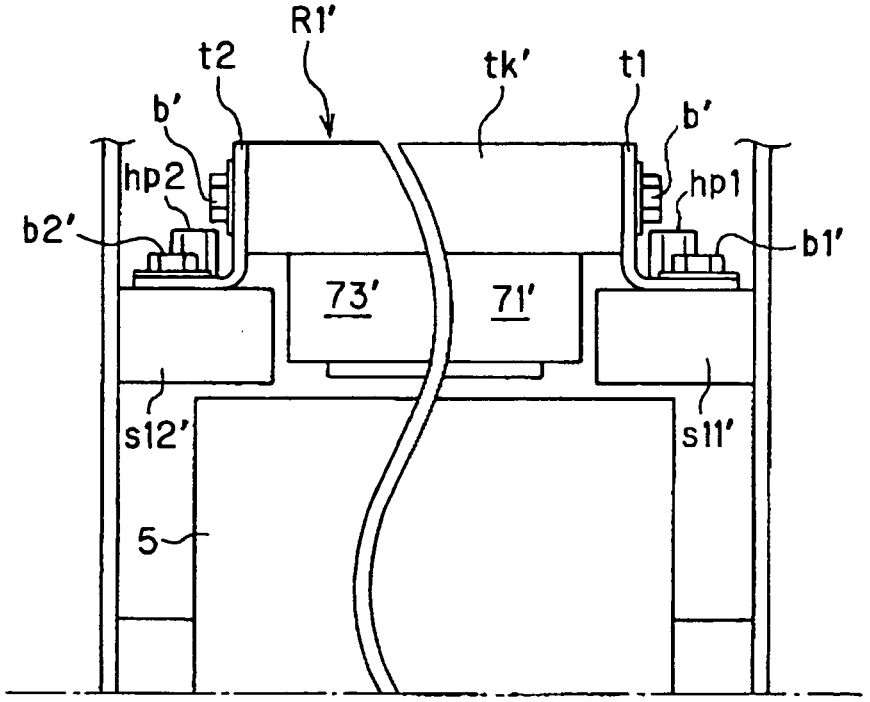

As shown in FIG. 4, a conceptual side expanded view, FIG. 5A a top view of FIG. 4, and FIG. 5B, a view in the direction of arrow C of FIG. 4, a photoresistor R1' has a construction such that LPH (exposure heads) 71', 72', 73'are arranged in prescribed locations in the exposure unit housing tk' of the exposure unit R1, a mounting bracket t1 on one end of the exposure unit housing tk' is secured by bolts b', b', and a mounting bracket t2 on the other end of the exposure unit housing tk' is secured by bolts b', b'.

Mounting brackets t1, t2 each have rectangular adjusting holes t1*a* , t2*a* which are sufficiently larger than the outer diameter of hexagonal eccentric pins (position adjusting unit) hp1, hp2 which are vertically positioned in supports (supporting unit) s11', s12' on the sides of the apparatus body so that the eccentric pins hp1, hp2 can pass through and fit with free play. These eccentric pins hp1, hp2 are formed such that the dimension from the center line to each of the hexagonal edges increases in steps.

With this structure, as shown in FIG. 5A, one side of the adjusting hole t1*a* of the mounting bracket t1 will strike on one of the hexagonal sides of the eccentric pin hp1, and mounting bracket t1 is secured to the support s11' on the side of the apparatus body by bolts b1', b1', and furthermore, one side of the adjusting hole t2*a* of the mounting bracket t2 will strike on one of the hexagonal sides of the eccentric pin hp2, and mounting bracket t2 is secured to the support s12' on the side of the apparatus body by bolts b2', b2', and thereby exposure unit R1' is positioned and secured with regards to the outer circumferential surface of the photosensitive drum 5.

Therefore, as shown in FIG. 5A, adjustment of the position of the mounting bracket t1 in the direction of arrow a is possible by rotating the eccentric pin hp1 to select one of the sides and then securing in place, and adjustment of the position of the mounting bracket t2 in the direction of arrow b is possible by rotating the eccentric pin hp2 to select one of the sides and then securing in place. Therefore, a sliding position adjustment is made on both sides of the exposure unit R1' and the respective image forming distances of the LPH 71', 72', 73' with regards to the outer circumferential surface of the photosensitive drum 5 can be adjusted.

With the aforementioned construction, the eccentric pins hp1, hp2 are secured to the side of the apparatus body as the position adjusting unit for the exposure unit R1, so even if any one of the LPH 71', 72', 73' breaks down and is replaced with a new exposure unit R1', adjusting the position of the LPH 71', 72', 73', of the new exposure unit R1' will not be necessary.

Furthermore, this alternate example will of course have the same functional effects as embodiment 1.

Embodiment 2

Embodiment 2 uses the exposure unit R1 shown in embodiment 1, but changes the structure of the support member which adjusts and secures the exposure unit R1.

Figure 6B:
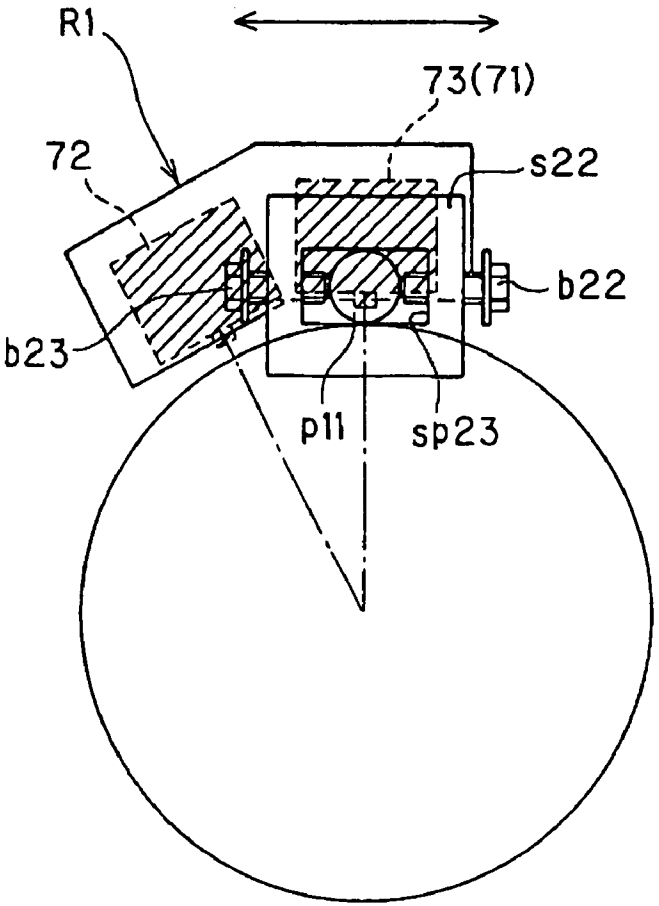
FIG. 6A and FIG. 6B are a conceptual side view showing the area around the exposure device and photosensitive drum of embodiment 2 of the present invention, and a conceptual side view of the area around the exposure device and photosensitive drum shown in FIG. 6A.
Figure 6A:
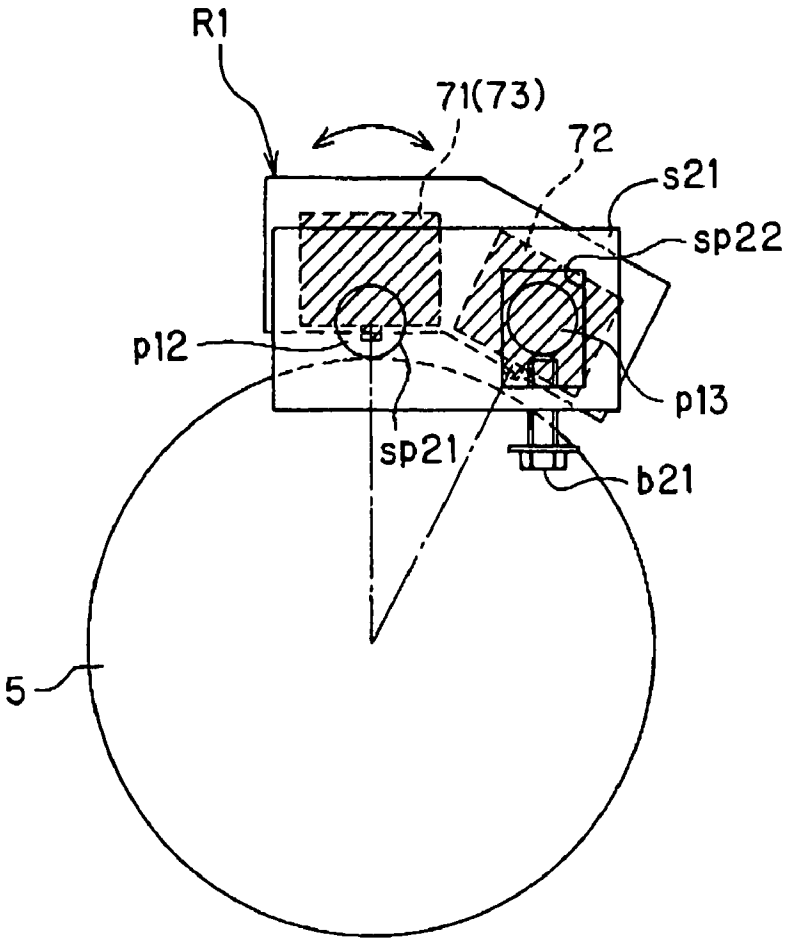

In other words, as shown FIG. 6A, on one side of the exposure unit R1, a conceptual side view, a support member (supporting unit) s21 which is the focus standard has a hole (position adjusting mechanism) sp21 through which a pin p12 for exposure unit R1 is inserted and rotatably supported, and an adjusting hole (position adjusting mechanism) sp22 wherein a pin p13 of the exposure unit R1 can be fit and adjusted by sliding, and this support member s21 is secured to the apparatus body where the photosensitive drum 5 and the like are established. Adjustment screws (position adjusting mechanism) b21 are screwed into the bottom of the adjusting hole sp22 of this support member s21.

On the other hand, on the other end of the exposure unit R1, as shown in FIG. 6B, a view from the back side of FIG. 6A, support member (supporting unit) s22 which is the focus standard has an adjusting hole (position adjusting mechanism) sp23 through which the pin p11 of the exposure unit R1 can fit and adjust by sliding, and this supporting member s22 is secured to the apparatus body wherein the photosensitive drum 5 and the like is established. Both sides of this support member s22 are screwed in place by adjusting screws (position adjusting mechanism) b22, b23.

With this construction, as shown in FIG. 6A, the pin p12 of the exposure unit R1 is inserted into and pivotally supports the hole sp21 of the support member s21, and the pin p13 of the exposure unit R1 is inserted into the adjustment hole sp22 and pressed upon by adjusting screw b21, so one end of the exposure unit R1 is rotationally adjusted as shown by the arrow and positioned by the region around the pin p12 which is supported by the hole sp21 of the support member s21.

Furthermore, by fitting the pin p11 of the exposure unit R1 into the adjusting hole sp23 of the support member s22 and applying pressure by adjusting screws b22, b23, the other end of the exposure unit R1 is adjusted by sliding and positioned in the direction of the arrow by adjusting screws b22, b23.

With this construction, the adjusting points of the exposure unit R1 are in two locations at both supporting members, but embodiment 2 differs from the structure of embodiment 1 in that one of the studs is made to pivot so that one end of the exposure unit R1 is adjusted by rotation.

With this mechanism, when the degree of adjustment of the two seam regions of LPH 71, 72 and LPH 72, 73 are to be changed, one end of the exposure unit R1 is adjusted by sliding, and the other end of the exposure unit R1 is adjusted by rotating. With embodiment 1, as shown in FIG. 2A, adjustments must be performed by the two adjusting screws b11, b12 even if adjusting the left and right sides by the same amount, but with embodiment 2, as shown in FIG. 6A, adjusting can be completed by adjusting only one adjusting screw b12, so the number of adjusting steps can be reduced.

Therefore, the image forming distance of LPH 71, 72, 73 with regards to the outer circumferential surface of the photosensitive drum 5 can be adjusted, and therefore intensity variation at the edge of LPH 71 and the edge of LPH 72, and intensity variation at the edge of LPH 72 and the edge of the LPH 73 can be prevented.

Embodiment 3

An exposure unit R3 shown in embodiment 3 is identical to the exposure unit R1 of embodiments 1 and 2 with regards to the arrangements of the LPH on the photoreceptor housing, and only the structure of the vertical pins on both sides of the exposure unit housing have been changed.

Therefore, structural elements which are identical in exposure unit R3 and exposure unit R1 have been assigned the same code, and only the structural differences will be discussed.

Figure 7:
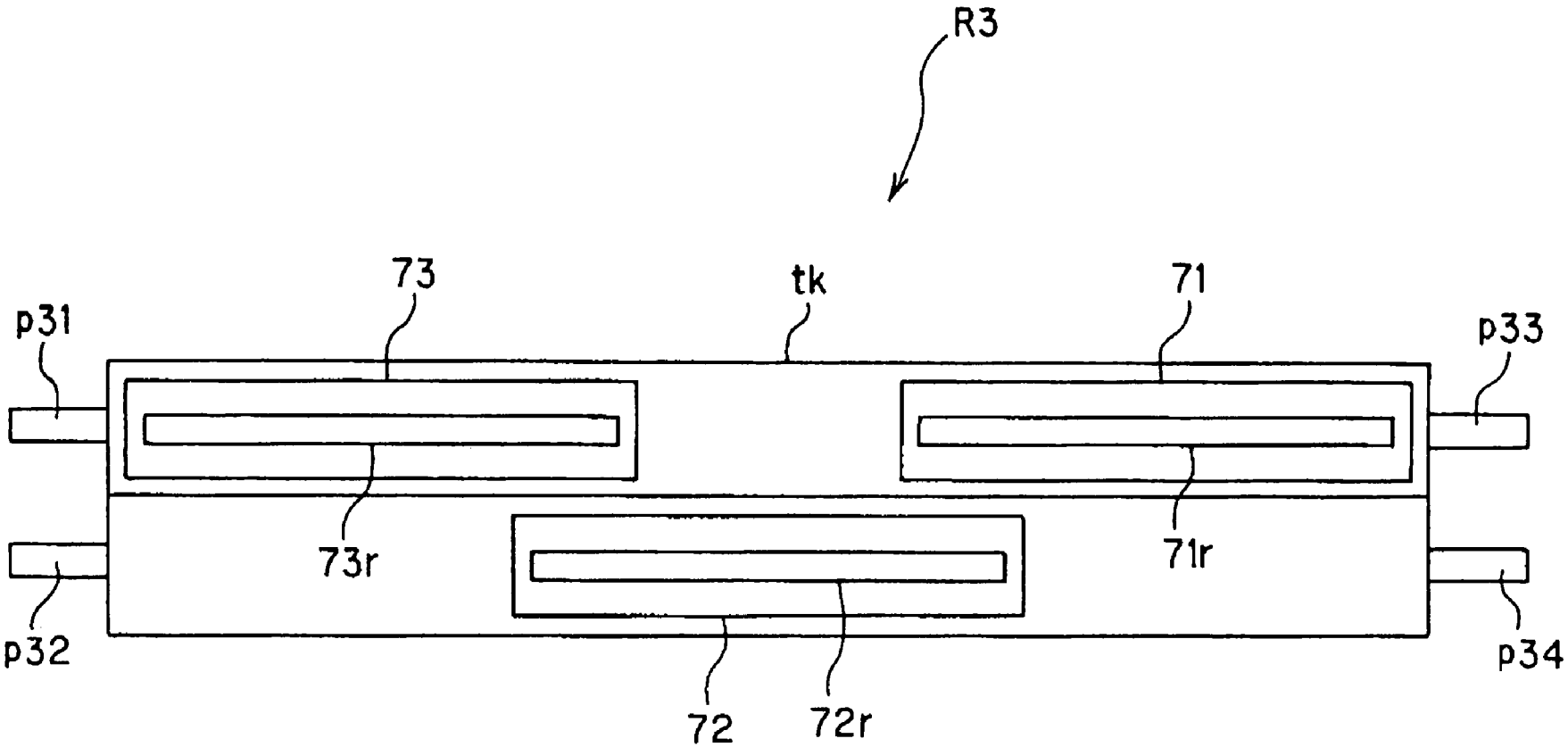
FIG. 7 is a diagram showing an exposure device of embodiment 3 (D direction view of the exposure device shown in FIG. 8A seen from the D direction)

As shown in FIG. 7, exposure unit R3 is formed with two studs formed by crimping the cylindrical pins p31, p32 at one end of the exposure unit housing tk of the exposure unit R3, and two studs formed by crimping the cylindrical pins p33, p34 at the other end.

The structure of the apparatus body side which adjusts the position and secures the exposure unit R3 is as shown below.

Figure 8B:
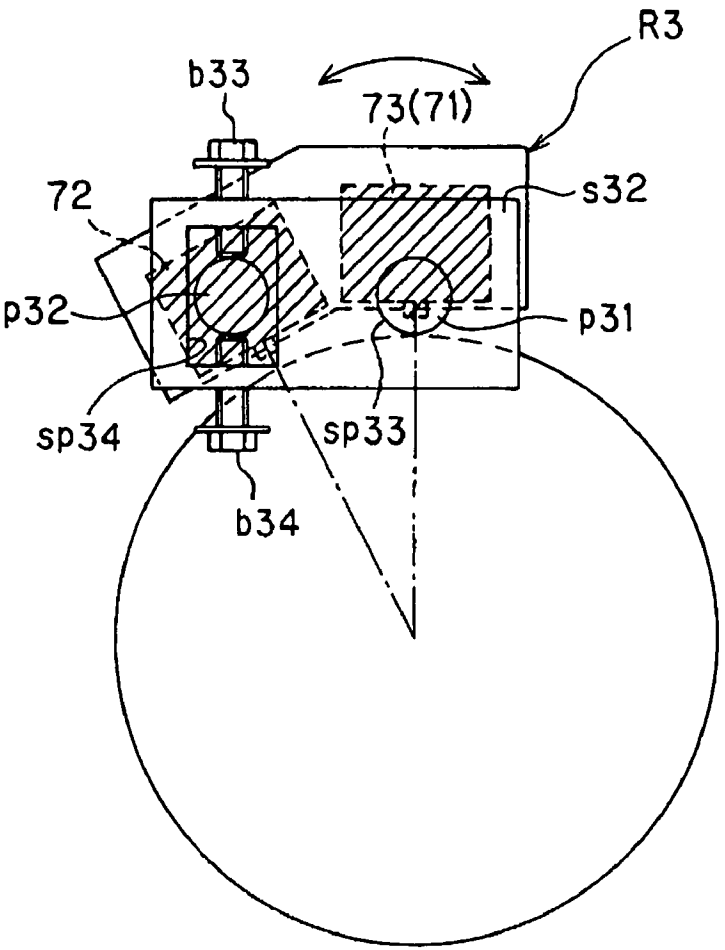
FIG. 8A and FIG. 8B is a conceptual side view showing the region around the exposure device and photosensitive drum of embodiment 3 of the present invention, and a conceptual side view showing the region around the exposure device and photosensitive drum of embodiment 3 of the present invention seen from the back side.
Figure 8A:
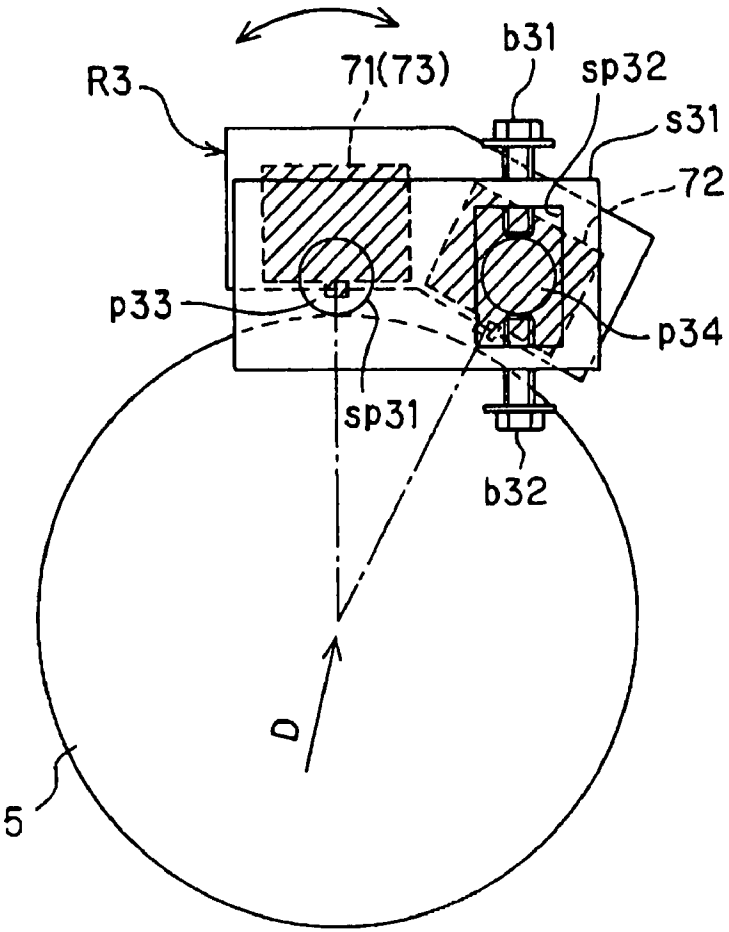
Figure 9A:
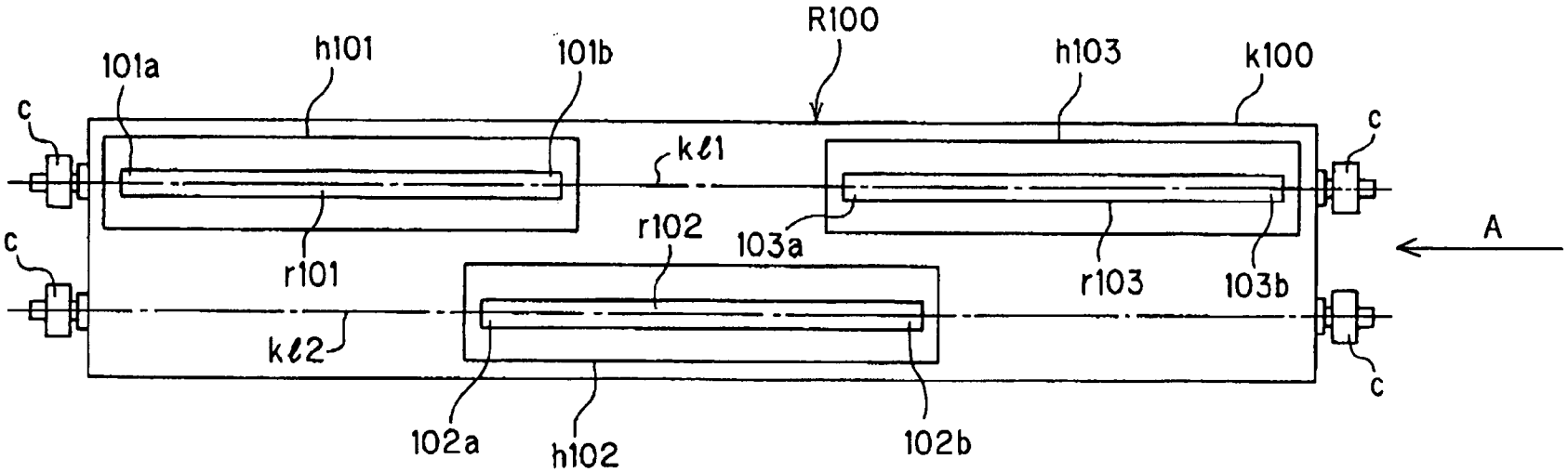
FIG.9A (RELATED ART)
FIG. 9A and FIG. 9B are a diagram showing a conventional exposure device and a view in the direction of arrow A of the exposure device shown in FIG. 9A.
Figure 9B:
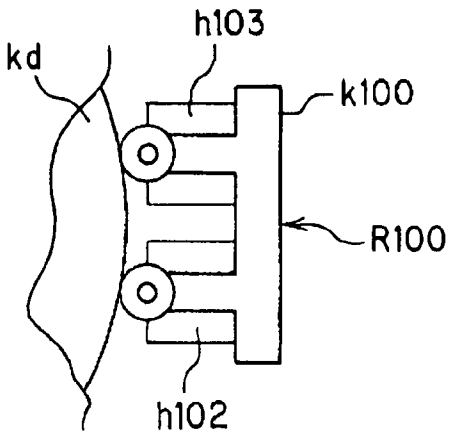
FIG.9B (RELATED ART)

In other words, as shown in FIG. 8A, on one end of the exposure unit R3, a support member (supporting unit) s31 which is the focus standard has a hole (position adjusting mechanism) sp31 through which the pin p33 of the exposure unit R3 is inserted and rotatably supported, and an adjusting hole (position adjusting mechanism) sp32 wherein the pin p34 of the exposure unit R3 is fit and adjusted by sliding, and this supporting member s31 is secured to the apparatus body wherein the photosensitive drum 5 and the like are established. The top part and the bottom part of the adjusting hole sp32 of this support member s31 each have adjusting screws (position adjusting mechanism) b31, b32.

On the other hand, as shown in FIG. 8B, a view from the back side of FIG. 8A, on the other end of the exposure unit housing tk of the exposure unit R3, a support member (supporting unit) s32 which is the focus standard has a hole (position adjusting mechanism) sp34 through which the pin p31 of the exposure unit R3 is inserted and rotatably supported, and an adjusting hole (position adjusting mechanism) sp34 wherein the pin p33 of the exposure unit R3 is fit and adjusted by sliding, and this supporting member s32 is secured to the apparatus body wherein the photosensitive drum 5 and the like is established. The top part and the bottom part of the adjusting hole sp34 of this support member s32 each have adjusting screws (position adjusting mechanism) b33, b34.

With this construction, as shown in FIG. 8A, the pin p33 of the exposure unit R3 is inserted into and pivotally supports the hole sp31 of the support member s31, and the pin p34 of the exposure unit R3 is inserted into the adjustment hole sp32 and pressed upon by adjusting screws b31, b32, so one end of the exposure unit R3 is rotationally adjusted as shown by the arrow and positioned by the area around the pin p33 which is supported by the hole sp31 of the support member s31.

With this construction, as shown in FIG. 8B, the pin p31 of the exposure unit R3 is inserted into and pivotally supports the hole sp33 of the support member s32, and the pin p32 of the exposure unit R3 is inserted into the adjustment hole sp34 and pressed upon by adjusting screws b33, b34, so the other end of the exposure unit R3 is rotationally adjusted as shown by the arrow and positioned by the area around the pin p31 which is supported by the hole sp33 of the support member s32.

With this structure, the exposure unit R3 is adjusted at both ends of the support position, and the adjustment is performed by rotation at the both ends.

Accordingly, both ends of the exposure unit R3 are rotated in the same direction or both ends of the exposure unit R3 are rotated in opposite directions, thereby the exposure unit R3 is twisted and deformed, so that the image forming distance of the LPH 71, 72, 73 can be adjusted so that the intensity differences at the seam region of LPH 71, 72 and the seam region of LPH 72, 73 can be eliminated.

In other words, it is possible to twist and deform a straight exposure unit R3 in order to align the image forming distance differences of LPH seams in two locations.

For the case of the slide adjustment of the embodiment 1 shown in FIG. 2, if the focal point difference of the LPH seam is preferentially eliminated so that the amount of adjustment is large, the image forming distance at the ends of the LPH 71 and the LPH 73 will become slightly worse. However, by using the method of embodiment 3 shown in FIG. 8, the image forming distance of LPH 72 can be changed while having almost no affect on the image forming distance of the LPH 71 and the LPH 73. Therefore, this is an effective method if a big adjustment is to be made in LPH 72.

In addition to the aforementioned embodiments 1 through 3, if the exposure unit has more than three LPH, the number of head seams will also increase, so a combination of only slide adjusting and rotation adjusting will be insufficient. In this case, the image forming distance difference of plural LPH seams can be adjusted for by a method of intentionally warping the exposure unit housing by having a screw strike the region of the seam of the LPH of the exposure unit housing.

The present invention can be effectively used for standard printers, plotters, devices which form an image on blank sheets such as paper bills, and securities or the like, as well as other types of image forming devices so long as the image forming device uses a rotating photoreceptor and exposure units.

The entire disclosure of Japanese Patent Application No. 2004-326502 filed on Nov. 10, 2004 including specification, claims, drawings, and abstract is incorporated herein by reference in its entirety.

What is claimed is:

1. An image forming device, comprising:

a cylindrical rotatable photoreceptor rotatably supported by an apparatus body;

an exposure device in which plural exposure heads which expose an outer circumferential surface of the rotatable photoreceptor are disposed in a common housing in such a manner that exposure sections thereof are consecutively positioned; and a supporting unit having a position adjusting mechanism for adjusting a posture of the exposure device in at least two locations, which supports the exposure device and which is fixed on the apparatus body, wherein the exposure device includes a plurality of projections which extend, in a direction substantially parallel to a rotational axis of the rotatable photoreceptor, from at least one end of the exposure device;

wherein the projections are engaged with the supporting unit; and wherein the posture of the exposure device is adjusted by adjusting locations of the projections.

2. The image forming device according to claim 1, wherein the position adjusting mechanism is disposed on both ends of the exposure device and adjusts the posture of the exposure device by sliding support positions of the exposure device.

3. The image forming device according to claim 1, wherein the position adjusting mechanism is provided on both ends of the exposure device, one of the position adjusting mechanism adjusting the posture of the exposure device by sliding a support position of the exposure device, and other one of the position adjusting mechanism adjusting the posture of the exposure device by rotating the exposure device around a longitudinal axis thereof.

4. An image forming device according to claim 1, wherein the position adjusting mechanism changes more greatly an image forming distance from a specified exposure head, among image forming distances from the plural exposure heads to the outer circumferential surface of the rotational photoreceptor.

5. An image forming device according to claim 1, wherein performing an adjustment of at least one of the at least two locations of the position adjusting mechanism twists and deforms the housing of the exposure device.

6. An image forming device according to claim 1, wherein the plurality of projections comprises at least two projections projecting from a first end of the exposure device, and at least one projection projecting from a second end of the exposure device, opposite the first end.

7. An image forming device according to claim 1, wherein the plural exposure heads comprise at least two exposure heads which are substantially axially aligned and at least one exposure head which is offset from the at least two exposure heads along a circumferential direction of the rotatable photoreceptor.

8. An image forming device according to claim 1, wherein the adjusting mechanism comprises an adjusting hole and adjustment screws.

9. An image forming device according to claim 8, wherein at least some of the plurality of projections are fitted in the adjusting hole and the locations of the at least some of the plurality of projections are adjusted by moving the adjustment screws.

10. An image forming device according to claim 1, wherein the projections are pins.

* * * * *